US005842452A

United States Patent [19]

Pattanaik

[11] Patent Number: 5,842,452

[45] Date of Patent: Dec. 1, 1998

[54] IDLE STABILIZING VARIABLE AREA INLET FOR A HYDRAULICALLY-ACTUATED FUEL INJECTION SYSTEM

[76] Inventor: Satish Pattanaik, 2500 Lake In The Woods Blvd., Ypsilanti, Mich. 48198

[21] Appl. No.: 978,328

[22] Filed: Nov. 25, 1997

[51] Int. Cl.[6] ..... F02M 37/04

[52] U.S. Cl. ..... 123/467; 123/446

[58] Field of Search ..... 123/467, 446, 123/506, 456, 447

[56] References Cited

U.S. PATENT DOCUMENTS

| | | | |
|---|---|---|---|
| 3,742,926 | 7/1973 | Kemp | 123/467 |
| 4,246,876 | 1/1981 | Bouwkamp | 123/467 |
| 4,628,957 | 12/1986 | Hofer | 123/467 |
| 5,191,867 | 3/1993 | Glassey | 123/446 |
| 5,245,970 | 9/1993 | Iwaszkiewicz | 123/447 |
| 5,297,523 | 3/1994 | Hafner | 123/446 |
| 5,325,834 | 7/1994 | Ballheimer | 123/446 |
| 5,357,929 | 10/1994 | McCandless | 123/446 |
| 5,375,576 | 12/1994 | Ausman | 123/467 |
| 5,499,608 | 3/1996 | Meister et al. | 123/467 |
| 5,509,391 | 4/1996 | DeGroot | 123/467 |
| 5,517,972 | 5/1996 | Stockner | 123/496 |
| 5,669,355 | 9/1997 | Gibson | 123/446 |
| 5,715,795 | 2/1998 | Guentert | 123/467 |

*Primary Examiner*—Carl S. Miller
*Attorney, Agent, or Firm*—Michael B. McNeil

[57] ABSTRACT

A hydraulically-actuated fuel injection system includes a manifold holding an amount of pressurized actuation fluid therein. A plurality of hydraulically-actuated fuel injectors each has an injector body that defines an actuation fluid cavity adjacent a piston. A plurality of branch passages each has one end connected to the manifold and a second end connected to the actuation fluid cavity of a different one of the plurality of hydraulically-actuated fuel injectors. A flow orifice valve member is positioned in each of the branch passages and is moveable between a first position that presents a relatively small flow area through the branch passage when pressure in the manifold is relatively low, and a second position that presents a relatively large flow area when pressure in the manifold is relatively high.

20 Claims, 4 Drawing Sheets

IDLE STABILIZING VARIABLE AREA INLET FOR A HYDRAULICALLY-ACTUATED FUEL INJECTION SYSTEM

TECHNICAL FIELD

The present invention relates generally to hydraulically-actuated fuel injection systems, and more particularly to a variable area inlet for a hydraulically-actuated fuel injection system that stabilizes an engine while operating at an idle condition.

BACKGROUND ART

In one class of hydraulically-actuated fuel injection systems, a high pressure actuation fluid moves a piston within each fuel injector to pressurize fuel during an injection event. Each individual fuel injector is connected to a high pressure actuation fluid manifold with a separate branch passage. Each fuel injector includes a solenoid actuated control valve that opens and closes an interior actuation fluid cavity to the high pressure actuation fluid manifold. Each injection event is initiated by opening the control valve, and each injection event is ended by closing the control valve. While different types of fluid could conceivably be utilized as the actuation fluid medium, Caterpillar, Inc. of Peoria, Ill. has found considerable success in using engine lubricating oil as the actuating fluid in its hydraulically-actuated fuel injection systems.

When an engine is operating at an idle condition, each fuel injector needs only to inject a relatively small amount of fuel during each injection event. As a consequence, the control valve for the individual injector is commanded to open for only a relatively brief amount of time. In some instances, the amount of time that the control valve is commanded to open is so brief that it does not even reach its completely open position before it is commanded to close. The duration of an injection event at idle conditions is also relatively short despite the fact that the pressure in the actuation fluid manifold is generally decreased to a relatively lower pressure during idle. In some fuel system applications, engineers have observed that the amount of fuel injected in successive injection events at idle conditions can vary significantly. This in turn can cause an engine to behave somewhat less than smoothly (i.e. rpm surges, noise, engine vibrations, etc.) when operating at an idle condition.

In some fuel injectors, reductions in NOx emissions and combustion noise are achieved at idle conditions by producing a split injection. In one example, this initial rate shaping has been successfully introduced by spilling fuel to a return line instead of out of the nozzle during the initial portion of each injection event. The initial injection rate is reduced by allowing a significant amount of controlled fuel spillage through a plunger groove and/or holes in a barrel port. This spillage concept has been an effective front end rate shaping method, providing a significant amount of combustion and noise reduction and achieving significant overall noise reduction. However, fuel injectors employing this split injection rate shaping strategy can be even more sensitive to so called idle instability problems. In other words, since the fuel is being injected in two tiny amounts rather than one small amount at idle, the variation in the amount of fuel injected can be even more significant.

One source of the idle instability is believed due to the movement of pressure waves between individual injectors and other injectors via the high pressure fluid manifold. In other words, a pressure wave is generated each time the control valve of an individual injector closes at the end of an injection event. This pressure wave passes from the injector up its branch passage and into the high pressure manifold. Because the injectors open and close sequentially with the engine cycle, a pressure wave produced by one injector will often reach a different injector while it's control valve is open. In addition to the fuel injectors, the high pressure oil pump generates pressure spikes that travel into and through the manifold. The pressure dynamics in the manifold in turn travel to the individual fuel injectors. A pressure wave can cause the amount of fuel injected to be considerably greater than one would expect based upon an assumption that the manifold pressure remains relatively constant throughout the operation of the system.

Hydraulically-actuated fuel injectors for a given engine must necessarily have the ability to perform over a broad range of fuel injection quantity demands and injection pressures. As a consequence, the injector must have the ability to deliver relatively small amounts of fuel at idle, but also have the ability to deliver relatively large amounts of fuel at rated and peak torque operating conditions. In order to perform across this range, the actuation fluid pressure at idle is made relatively low and the injection duration is extremely short, whereas the manifold pressure at rated conditions is relatively high and the injection duration is significantly longer. It has been observed that in some systems, the duration of injection and quantity of fuel at idle is so short that small but significant variations in fuel quantity can develop, particularly when split injection rate shaping is employed at idle. By stabilizing an engine operating at idle conditions, decreasing noise levels can also be attained.

The present invention is directed to overcoming these and other problems associated with stabilizing the idle operation of an engine utilizing a hydraulically-actuated fuel injection system.

DISCLOSURE OF THE INVENTION

In one embodiment, a hydraulically-actuated fuel injection system includes a manifold holding an amount of pressurized actuation fluid therein. A plurality of hydraulically-actuated fuel injectors each has an injector body defined in actuation fluid cavity adjacent a piston. A plurality of branch passages each has one end connected to the manifold and a second end connected to the actuation fluid cavity of a different one of the plurality of hydraulically-actuated fuel injectors. A flow orifice valve member is positioned in each of the branch passages, and is moveable between a first position that presents a relatively small flow area through the branch passage when pressure in the manifold is relatively low, and a second position that presents a relatively large flow area when pressure in the manifold is relatively high.

In another embodiment, a hydraulically-actuated fuel injection system includes a manifold holding an amount of pressurized actuation fluid therein. A plurality of hydraulically-actuated fuel injectors each has an injector body that defines an actuation fluid cavity adjacent a piston. A plurality of branch passages each has one end connected to the manifold and a second end connected to the actuation fluid cavity of a different one of the plurality of hydraulically-actuated fuel injectors. A flow orifice valve member is positioned in each of the branch passages and has a pressure surface exposed to fluid pressure in the manifold. The flow orifice valve member is moveable between a first position that presents a relatively small flow area through the branch passage, and a second position that presents a relatively large flow area through the branch passage. A compression spring is operably positioned to bias the flow orifice valve member toward its first position.

In still another embodiment, a hydraulically-actuated fuel injection system includes a manifold that holds an amount of pressurized actuation fluid therein. A plurality of hydraulically-actuated fuel injectors each has an injector body that defines an actuation fluid cavity adjacent a piston. A plurality of branch passages each has one end connected to the manifold and a second end connected to the actuation fluid cavity of a different one of the plurality of hydraulically-actuated fuel injectors. A control valve member is positioned in each of the branch passages, and is moveable between an open position in which the actuation fluid cavity is open to the branch passage, and a closed position in which the actuation fluid cavity is closed to the branch passage. The control valve member is moveable to a partially open position, which is between its open position and its closed position, when the hydraulically-actuated fuel injector is operating in an idle condition. A flow orifice valve member is positioned in each of the branch passages, and is moveable between a first position that presents a relatively small flow area through the branch passage, and a second position that presents a relatively large flow area through the branch passage.

BEST MODE FOR CARRYING OUT THE INVENTION

Figure 1:
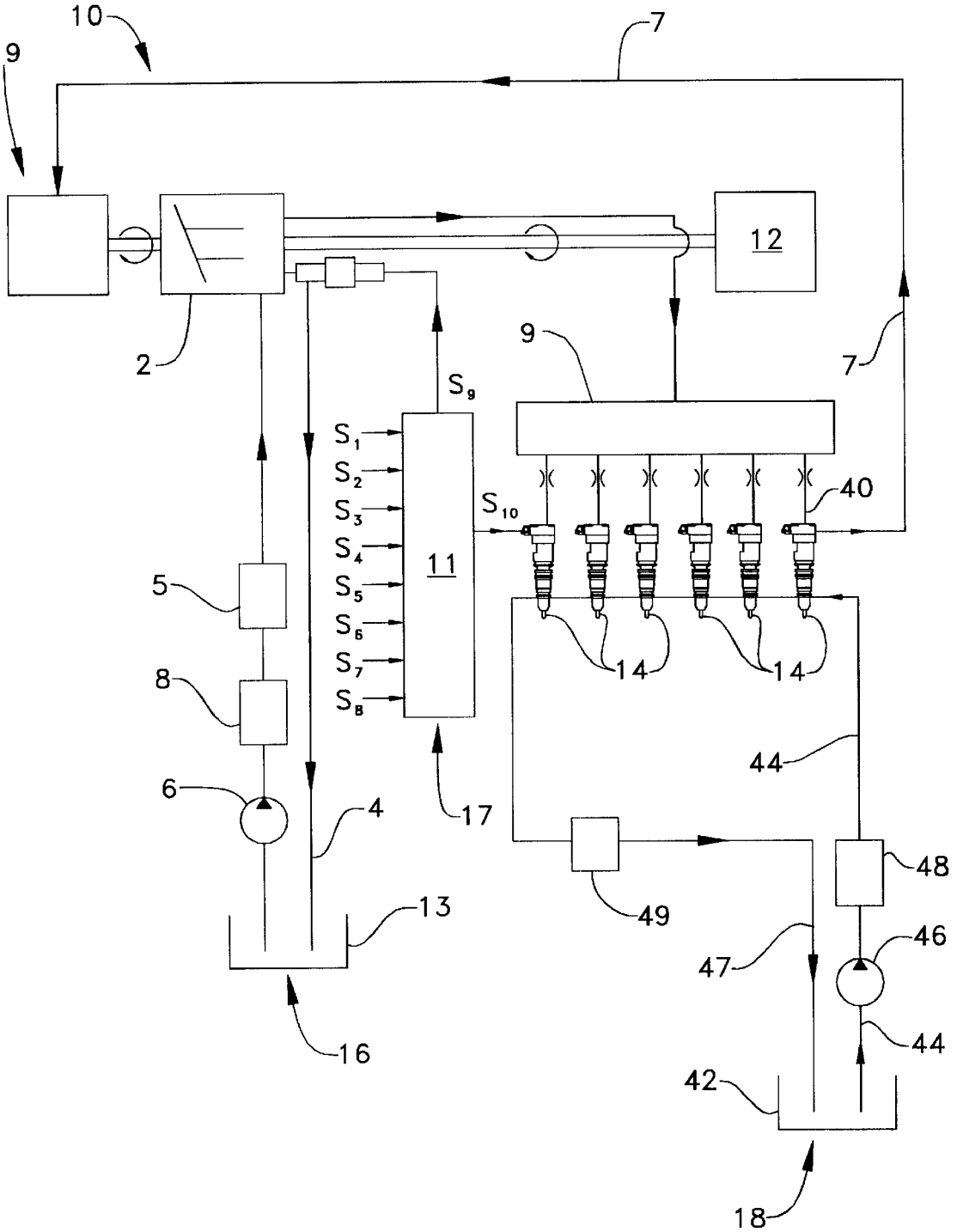
FIG. 1 is a schematic view of a hydraulically-actuated fuel injection system according to the present invention.

Referring now to FIG. 1, there is shown an embodiment of a hydraulically-actuated electronically controlled fuel injection system 10 in an example configuration as adapted for a direct injection diesel cycle internal combustion engine 12. Fuel system 10 includes one or more hydraulically-actuated electronically controlled fuel injectors 14, which are adapted to be positioned in a respective cylinder head bore of engine 12. Fuel system 10 includes an apparatus 16 for supplying actuating fluid to each injector 14, an apparatus 18 for supplying fuel to each injector, a computer 17 for electronically controlling the fuel injection system and an apparatus 19 for recirculating actuation fluid.

The actuating fluid supply apparatus 16 preferably includes an actuating fluid sump 13, a relatively low pressure actuation fluid transfer pump 6, an actuation fluid cooler 8, one or more fluid filters 5, and a high pressure pump 2 for generating relatively high pressure in the actuation fluid at a manifold 9. Manifold 9 is arranged in fluid communication with the outlet from the high pressure actuation fluid pump 2. An external branch passage 40*a* connects the actuation fluid inlet 21 of each injector 14 to the high pressure manifold 9.

Actuation fluid leaving the actuation fluid drain 22 (FIG. 2) of each injector 14 enters a recirculation line 7 that carries the same to the hydraulic energy recirculating or recovering apparatus 19. A portion of the recirculated actuation fluid is channeled to high pressure pump 2 and another portion is returned to actuation fluid sump 13 via recirculation line 4. Any available engine fluid is preferably used as the actuation fluid in the present invention. However, in the preferred embodiments, the actuation fluid is engine lubricating oil and the actuation fluid sump 13 is an engine lubrication oil sump. This allows the fuel injection system 10 to be connected as a subsystem to the engine's lubricating oil circulation system. Alternatively, the actuation fluid could be provided by a fuel tank 42 or another source, such as coolant fluid, etc. The fuel supply apparatus 18 preferably includes a fuel tank 42, a fuel supply passage 44 arranged in fluid communication between fuel tank 42 and the fuel inlet of each injector 14. Also included is a relatively low pressure fuel transfer pump 46, one or more fuel filters 48, a fuel supply regulating valve 49, and a fuel circulation and return passage 47 arranged in fluid communication between injectors 14 and fuel tank 42.

A computer 17, which includes an electronic control module 11 contains software decision logic and information defining optimum fuel system operational parameters, and also controls key components of the fuel injection system, including manifold pressure and injector solenoid on-times. Electronic control module 11 receives input data signals from one or more signal indicating devices. For example, input data signals may include engine speed $S_1$, engine crank shaft position $S_2$, engine coolant temperature $S_3$, engine exhaust back pressure $S_4$, air intake manifold pressure $S_5$, manifold pressure $S_6$, throttle position or desired fuel setting $S_7$, and transmission operating condition $S_8$. The output control signal $S_9$ is directed to the high pressure pump and controls the pressure of the actuation fluid in manifold 9. The control signal $S_{10}$ (solenoid current) controls the injector solenoid on-time and hence the duration of each injection event. Each of the injection parameters are variably controllable independent of engine speed and load.

Figure 2:
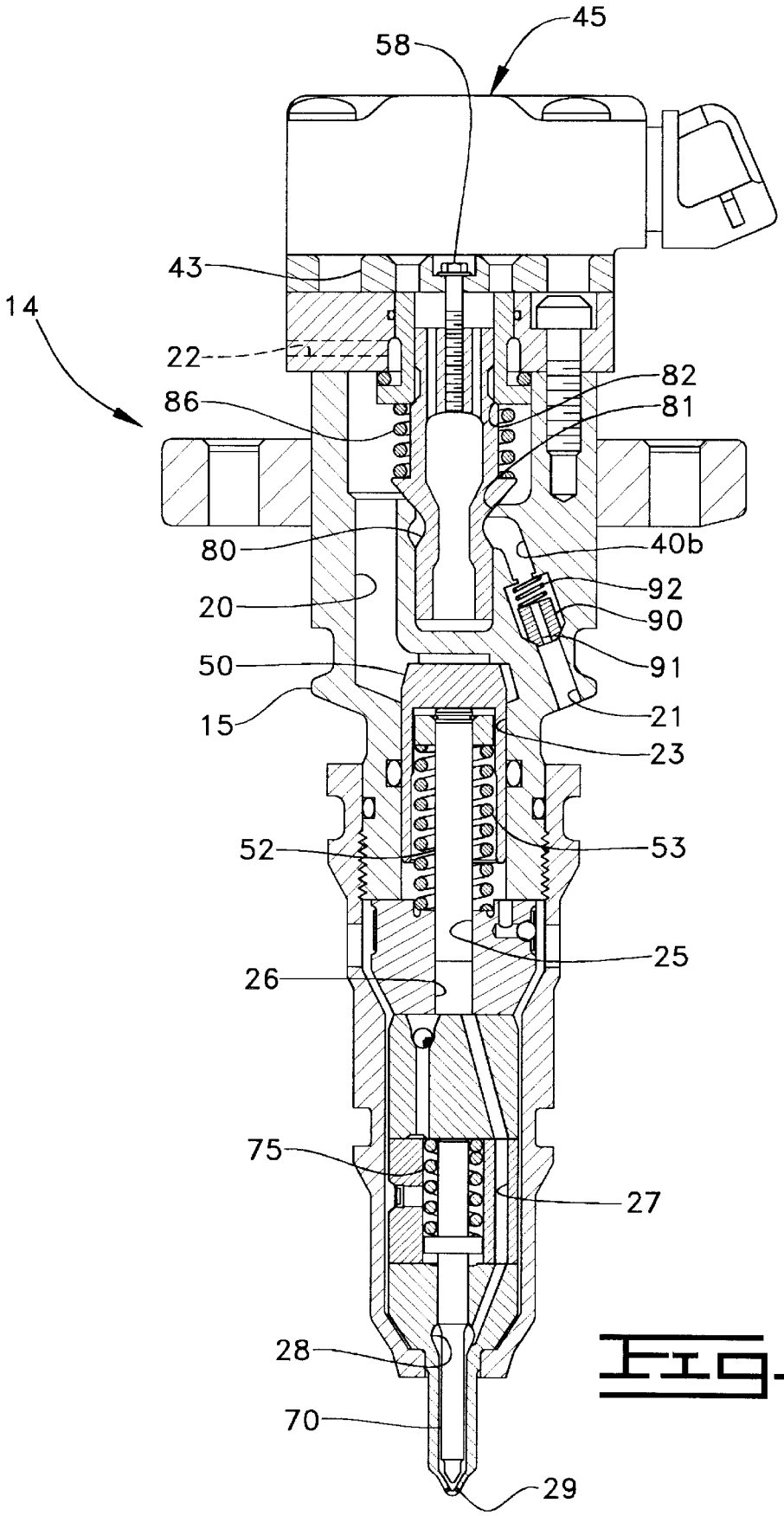
FIG. 2 is a sectioned side elevational view of a fuel injector according to the present invention.

Referring now to FIG. 2, hydraulically-actuated fuel injector 14 includes an injector body 15 made up of various components and containing various bores and passageways. In particular, injector body 15 includes an actuation fluid cavity 20 that opens to a piston bore 23, internal branch passage 40*b* past high pressure seat 81, and low pressure fluid drain 22 past low pressure seat 82. When solenoid 45 is energized, control valve member 80 lifts against the action of compression spring 86 to close seat 82 and open seat 81. This permits high pressure actuation fluid to flow through inlet 21 past flow orifice valve member 90 along internal branch passage 40*b* and into actuation fluid cavity 20. When solenoid 45 is de-energized, compression spring 86 biases control valve member 80 to close seat 81 and open low pressure seat 82. Thus, actuation fluid cavity 20 is normally opened to low pressure actuation fluid drain 22 when solenoid 45 is de-energized.

An intensifier piston 50 is positioned to reciprocate in piston bore 23 between a retracted position (as shown) and an advanced position. The piston moves downward when its upper hydraulic surface is exposed to high pressure actuation fluid. A return spring 53 maintains a plunger 52 in contact with the underside of intensifier piston 50, and biases both toward their retracted positions, as shown. Plunger 52 is positioned to reciprocate in plunger bore 25. A portion of plunger bore 25 and plunger 52 define a fuel pressurization chamber 26.

Injector body 15 further includes a nozzle chamber 28 that opens to fuel pressurization chamber 26 via a nozzle supply passage 27. Nozzle chamber 28 also opens to a nozzle outlet 29. A needle valve member 70 is positioned to reciprocate in nozzle chamber 28 between an open position in which nozzle outlet 29 is open, and a closed position in which nozzle outlet 29 is blocked. A compression spring 75 normally biases needle valve member 70 to its closed position. When fuel pressure in nozzle chamber 28 exceeds a valve opening pressure sufficient to overcome compression spring 75, the hydraulic force acting on the lifting hydraulic surfaces of needle valve member 70 cause it to lift and open nozzle outlet 29. Needle valve member 70 will remain in its open position for as long as fuel pressure is sustained above a valve closing pressure, which is usually lower than the valve opening pressure.

Figure 3A:
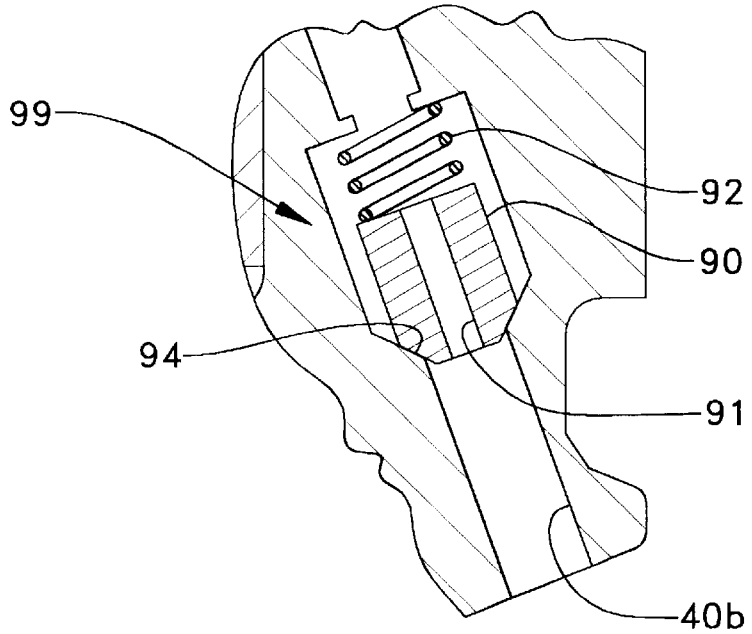
FIGS. 3*a* and 3*b* are partial sectioned side views of a flow orifice valve according to one aspect of the present invention in its first and second positions, respectively.
Figure 3B:
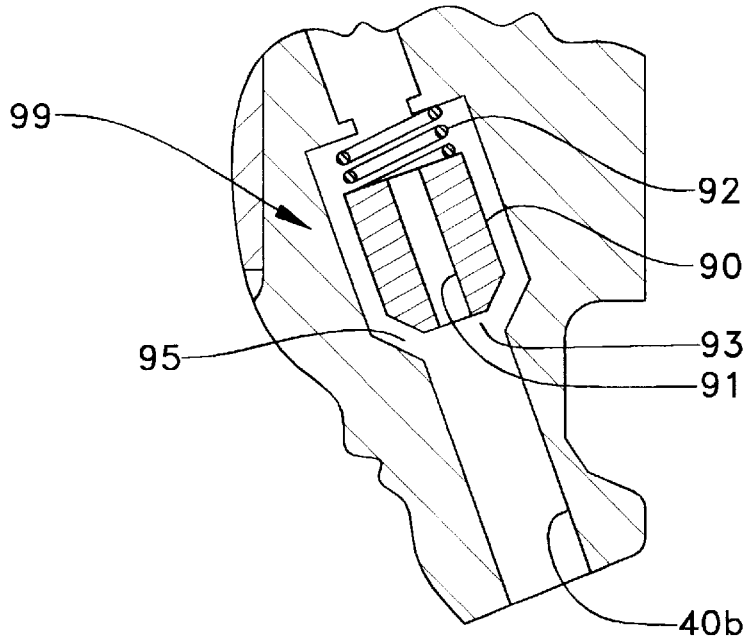

Referring now in addition to FIGS. 3*a* and 3*b*, flow orifice valve 99 includes a flow orifice valve member 90 having a pressure surface 93 exposed to fluid pressure upstream in the high pressure manifold 9. Flow orifice valve member 90 is normally biased to a first position as shown in FIG. 3*a* by a compression spring 92. When in this first position, the valve member is positioned against a seat 94 such that the flow area through branch passage 40*b* is restricted to a relatively small flow area 91. When fluid pressures are sufficiently high to overcome compression spring 92, flow orifice valve member 90 moves to its second position as shown in FIG. 3*b* in which internal branch passage 40*b* opens to present a relatively large flow area 95.

Before each injection event is initiated, flow orifice valve member 90 is in the position as shown in FIG. 3*a*. When the injection event is initiated, flow orifice valve member 90 will remain in the position shown in FIG. 3*a* if the upstream manifold pressure is relatively low, such as between 4 and 8 MPa, as in an idle condition. However, if the manifold pressure is relatively high, such as on the order of about 20 MPa, the flow orifice valve member will move to its second position as shown in FIG. 3*b* at the initiation of the injection event so that a relatively large flow area 95 is presented through internal branch passage 40*b*.

As shown in FIG. 2, flow orifice valve member 90 is preferably positioned upstream from control valve member 90. Furthermore, flow orifice valve member 90 is preferably positioned as close as possible to control valve member 80, and is preferably incorporated into injector body 15 as shown in FIG. 2. However, those skilled in the art will appreciate that flow orifice valve 99 can be positioned anywhere in either internal branch passage 40*b* or external branch passage 40*a* (FIG. 1) that extends between actuation fluid cavity 20 and high pressure manifold 9.

Industrial Applicability

Figure 4:
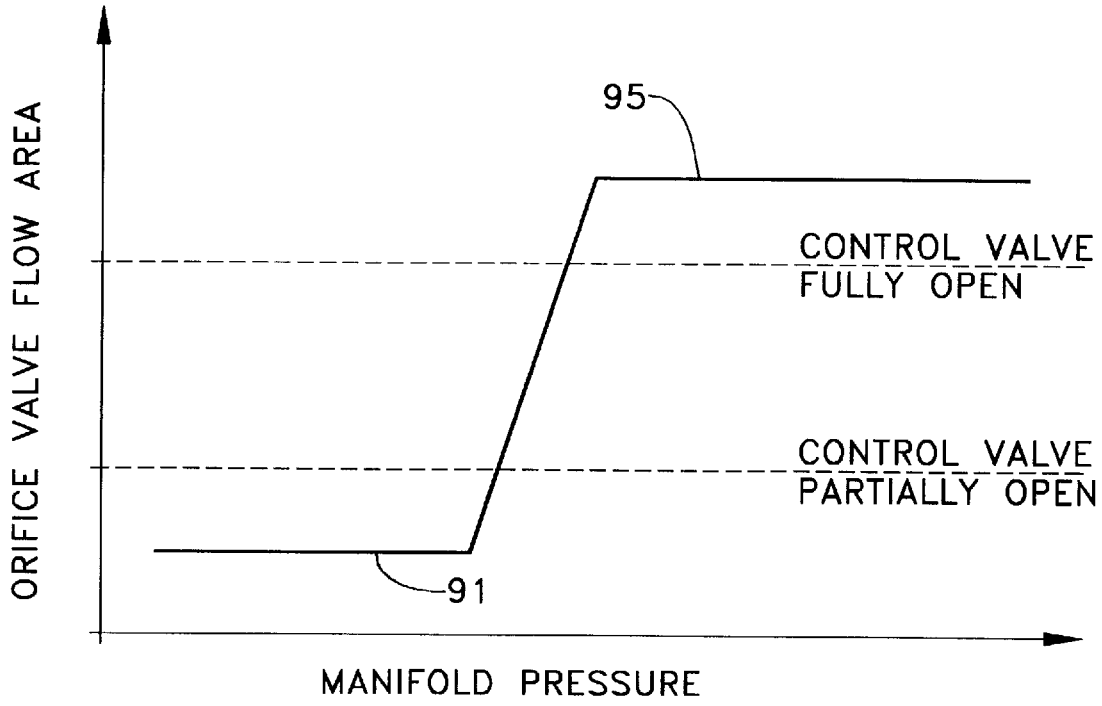
FIG. 4 is a graph of orifice valve flow area versus manifold pressure over a typical operating range for an engine utilizing a hydraulically-actuated fuel injection system according to the present invention.

Referring now in addition to FIG. 4, the manifold pressure is varied over the operating range of the engine such that it is relatively low during idle conditions and relatively high at rated conditions. This variation in manifold pressure is exploited to move the flow orifice valve member 90 between its first position as shown in FIG. 3*a* and its second position as shown in FIG. 3*b*. The relatively small flow area 91 and relatively large flow area 95 are chosen in relation to the flow areas past the control valve member when the system is operating at its idle and rated conditions, respectively. The relatively large flow 95 is chosen to be larger than the flow area past the control valve when the control valve is fully opened such that the only flow restriction between manifold 9 and actuation fluid cavity 20 occurs past the control valve member during rated conditions. At idle conditions, the control valve member only opens partially such that the flow area past the control valve member 80 is somewhat smaller than the flow area past the control valve member when the system is operating at rated conditions. This moves the flow restriction in the system from the control valve member where it occurs at rated conditions to the flow orifice valve member at idle conditions. Preferably, the relatively small flow area 91 is about 50% to 75% the size of the flow area past the control valve member when operating in its partially open state at idle conditions.

When operating at rated conditions, the flow orifice valve 99 has a negligible effect on the operation of fuel injector 14. However, when the system is operating at idle conditions, the flow orifice valve 99 stabilizes operation at idle conditions by damping the pressure waves traveling in either direction with respect to the flow orifice valve member. In other words, a pressure wave generated by closure of the control valve member 80 will be damped before it reaches manifold 9 as it passes through the relatively small flow area 91. Also, any pressure waves passing from manifold 9 to an injector will be damped by the presence of the relatively small flow area in the flow orifice valve member. This damping of pressure waves traveling in both directions between the fuel injectors and the high pressure manifold serves to decrease pressure fluctuations in the manifold and decreases the effect of any remaining variations in pressure on the operation of the individual fuel injectors. Thus, the fuel injection system operation at idle conditions is greatly stabilized and fluctuations in engine performance at idle conditions are substantially reduced.

In addition to reducing pressure fluctuations can the high pressure manifold and enabling the individual injectors to perform consistently from shot to shot, the flow orifice valve of the present invention also has the ability to reduce noise at idle conditions. This occurs because the flow restriction through the relatively small flow area of the flow orifice valve member necessarily requires that an injection duration at idle be longer than that of a prior art injector, with all other parameters being equal. An increased injection duration at idle is very desirable because of the noise reduction that often accompanies a more gradual combustion of fuel. If it is desired to maintain an idle injection duration in the present invention the same as that of prior art fuel injector, the manifold pressure must necessarily be increased an appropriate amount.

The above description is intended for illustrative purposes only and is not intended to limit the scope of the present invention in any way. For instance, those skilled in the art will appreciate that the flow orifice valve member can be positioned anywhere in the branch passage between the manifold and the actuation fluid cavity of the individual injectors. Furthermore, the flow orifice valve member need not be passively actuated by higher dynamic pressures produced by higher static pressures in the manifold, it could comprise a spool valve member that is moveable by fluid pressure acting on one end. In addition, while not preferable, the flow orifice valve member could also be electronically actuated and controlled based upon sensed pressure in the fluid manifold. Thus, those skilled in the art will appreciate that various modifications can be made to the illustrated embodiment of the present invention without departing from the intended scope of the invention, which is defined in terms of the claims as set forth below.

I claim:

1. A hydraulically actuated fuel injection system comprising:

a manifold holding an amount of pressurized actuation fluid therein;

a plurality of hydraulically actuated fuel injectors, each with an injector body defining an actuation fluid cavity adjacent a piston;

a plurality of branch passages, each with a first end connected to said manifold and a second end connected to said actuation fluid cavity of a different one of said plurality of hydraulically actuated fuel injectors; and a flow orifice valve member positioned in each of said branch passages, and being movable between a first position that presents a relatively small flow area through said branch passage when pressure in said manifold is relatively low, and a second position that presents a relatively large flow area when pressure in said manifold is relatively high.

2. The hydraulically actuated fuel injection system of claim 1 further comprising a control valve member positioned in each of said branch passages, and being movable between an open position in which said actuation fluid cavity is open to said branch passage, and a closed position in which said actuation fluid cavity is closed to said branch passage.

3. The hydraulically actuated fuel injection system of claim 2 further comprising a solenoid attached to said control valve member.

4. The hydraulically actuated fuel injection system of claim 3 wherein said control valve member is positioned between said actuation fluid cavity and said flow orifice valve member.

5. The hydraulically actuated fuel injection system of claim 4 wherein a flow area past said control valve member when in said open position is larger than said small flow area but smaller than said large flow area.

6. The hydraulically actuated fuel injection system of claim 4 wherein said flow orifice valve member has a pressure surface exposed to fluid pressure in said manifold; and a compression spring operably positioned to bias said flow orifice valve member toward said first position.

7. The hydraulically actuated fuel injection system of claim 4 wherein said small flow area is less than one half a flow area past said control valve member when in said open position.

8. The hydraulically actuated fuel injection system of claim 4 wherein said flow orifice valve member moves toward said first position when pressure in said manifold is less than about 8 MPa.

9. The hydraulically actuated fuel injection system of claim 4 wherein said control valve member and said flow orifice valve member are positioned in said injector body.

10. A hydraulically actuated fuel injection system comprising:

a manifold holding an amount of pressurized actuation fluid therein;

a plurality of hydraulically actuated fuel injectors, each with an injector body defining an actuation fluid cavity adjacent a piston;

a plurality of branch passages, each with a first end connected to said manifold and a second end connected to said actuation fluid cavity of a different one of said plurality of hydraulically actuated fuel injectors;

a flow orifice valve member positioned in each of said branch passages and having a pressure surface exposed to fluid pressure in said manifold, and being movable between a first position that presents a relatively small flow area through said branch passage, and a second position that presents a relatively large flow area through said branch passage; and a compression spring operably positioned to bias said flow orifice valve member toward said first position.

11. The hydraulically actuated fuel injection system of claim 10 further comprising a control valve member positioned in each of said branch passages, and being movable between an open position in which said actuation fluid cavity is open to said branch passage, and a closed position in which said actuation fluid cavity is closed to said branch passage.

12. The hydraulically actuated fuel injection system of claim 11 further comprising a solenoid attached to said control valve member.

13. The hydraulically actuated fuel injection system of claim 12 wherein said control valve member is positioned between said actuation fluid cavity and said flow orifice valve member.

14. The hydraulically actuated fuel injection system of claim 13 wherein a flow area past said control valve member when in said open position is larger than said small flow area but smaller than said large flow area.

15. The hydraulically actuated fuel injection system of claim 14 wherein said small flow area is less than one half a flow area past said control valve member when in said open position.

16. The hydraulically actuated fuel injection system of claim 15 wherein said control valve member and said flow orifice valve member are positioned in said injector body.

17. A hydraulically actuated fuel injection system comprising:

a manifold holding an amount of pressurized actuation fluid therein;

a plurality of hydraulically actuated fuel injectors, each with an injector body defining an actuation fluid cavity adjacent a piston;

a plurality of branch passages, each with a first end connected to said manifold and a second end connected to said actuation fluid cavity of a different one of said plurality of hydraulically actuated fuel injectors;

a control valve member positioned in each of said branch passages, and being movable between an open position in which said actuation fluid cavity is open to said branch passage, and a closed position in which said actuation fluid cavity is closed to said branch passage;

said control valve member being movable to a partially open position, which is between said open position and said closed position, when said hydraulically actuated fuel injector is operating in an idle condition; and a flow orifice valve member positioned in each of said branch passages, and being movable between a first position that presents a relatively small flow area through said branch passage, and a second position that presents a relatively large flow area through said branch passage.

18. The hydraulically actuated fuel injection system of claim 17 wherein said flow orifice valve member is biased toward said first position when said hydraulically actuated fuel injector is operating in said idle condition; and said small flow area is smaller than a flow area past said control valve member when in said partially open position.

19. The hydraulically actuated fuel injection system of claim 18 wherein said flow orifice valve member is biased toward said second position when pressure in said manifold is relatively high;

fluid pressure in said manifold is relatively low when said hydraulically actuated fuel injector is operating in said idle condition.

20. The hydraulically actuated fuel injection system 19 wherein said large flow area is larger than a flow area past said control valve member when in said open position.

* * * * *